US007399156B2

(12) United States Patent
Sterner et al.

(10) Patent No.: US 7,399,156 B2
(45) Date of Patent: Jul. 15, 2008

(54) TURBINE HOUSING OF AN EXHAUST GAS TURBOCHARGER WITH A VARIABLE TURBINE GEOMETRY

(75) Inventors: Andreas Sterner, Möglingen (DE); Ralph Ronneburger, Illingen-Schützingen (DE); Guenther Weinland, Tiefenbronn (DE)

(73) Assignee: Dr. Ing. h.c.F. Porsche Aktiengesellschaft, Stuttgart (DE)

( * ) Notice: Subject to any disclaimer, the term of this patent is extended or adjusted under 35 U.S.C. 154(b) by 246 days.

(21) Appl. No.: 11/298,494

(22) Filed: Dec. 12, 2005

(65) Prior Publication Data

US 2006/0188367 A1 Aug. 24, 2006

(30) Foreign Application Priority Data

Dec. 10, 2004 (DE) ..... 10 2004 059 803
Jan. 14, 2005 (DE) ..... 10 2005 001 864

(51) Int. Cl.
*F01D 17/16* (2006.01)

(52) U.S. Cl. ..... 415/164; 415/165; 415/134

(58) Field of Classification Search ..... 415/134, 415/135, 164, 165, 206; 60/602; 417/406, 417/407

See application file for complete search history.

(56) References Cited

U.S. PATENT DOCUMENTS 4,657,476 A * 4/1987 Berg ..... 415/48
6,558,117 B1 * 5/2003 Fukaya et al. ..... 415/164

FOREIGN PATENT DOCUMENTS

DE 103 12 324 B3 6/2004
EP 1 099 838 A1 5/2001

OTHER PUBLICATIONS

European Search Report dated Jul. 20, 2006 with English translation of relevant portion (Seven (7) Pages).

* cited by examiner

*Primary Examiner*—Ninh H Nguyen
(74) *Attorney, Agent, or Firm*—Crowell & Moring LLP

(57) ABSTRACT

A turbine housing of an exhaust gas turbocharger with a variable turbine geometry is provided, having a support ring to which vanes are fastened which are adjustable for controlling the charge pressure, and having a covering ring for the vanes. The support ring and covering ring are spaced for forming a vane gap by spacing elements which are each penetrated by a holding element which is fastened in the support ring and/or the covering ring. The spacing elements have recesses which, during the operation of the exhaust gas turbocharger, permit a direct action of the exhaust gas flow upon the holding elements.

10 Claims, 2 Drawing Sheets

TURBINE HOUSING OF AN EXHAUST GAS TURBOCHARGER WITH A VARIABLE TURBINE GEOMETRY

CROSS-REFERENCE TO RELATED APPLICATION

This application claims priority under 35 U.S.C. §119 to German Application Nos. 10 2004 059 803.7 and 10 2005 001 864.5, filed Dec. 10, 2004, and Jan. 14, 2005, respectively, the entire disclosures of which are hereby incorporated herein by reference.

BACKGROUND AND SUMMARY OF THE INVENTION

The invention relates to a turbine housing of an exhaust gas turbocharger with a variable turbine geometry.

Exhaust gas turbochargers, in the case of which the supercharging pressure can be controlled by means of adjustable vanes, are known, for example, from German Patent Document DE 103 12 324 B3. In the turbine housing of such VTG (variable turbine geometry) chargers, a vane apparatus is fastened which consists of a support ring for the vanes, as well as a covering ring which is situated opposite the support ring while maintaining a vane gap distance. For the spacing of the support ring and the covering ring, spacing elements, for example, in the form of spacing sleeves, are provided which are arranged to be radially distributed around the circumference of both rings, which spacing elements are held or penetrated by corresponding fastening elements, for example, in the form of fastening screws. Particularly when these VTG chargers are used in the case of Otto engines, these components are exposed to high exhaust gas temperatures. In this case, the spacing elements, which are penetrated by the holding elements, are particularly critical. When the spacing elements are acted upon by a hot exhaust gas flow, they correspondingly expand in the longitudinal direction, while the holding elements are still relatively cold. This may lead to an unacceptable linear expansion of the holding elements beyond their yielding point. Conversely, in the event of a subsequent load jump (full load to lower partial load), first the spacing element is cooled by the exhaust gas flow while the holding element is still relatively hot. This leads to a faster shrinking of the spacing element with respect to the holding element. If the holding element is constructed as a fastening screw, this results in a loss of prestressing force. As a result of loss of prestressing force, the fastening screw now has to absorb all transverse forces occurring because of the engine operation, which, under certain circumstances, may lead to component failure of the fastening screw.

It is an object of the invention to overcome the above-described disadvantages so that a reliable continuous operation of the VTG charger is guarantied.

As a result of recesses provided in the spacing elements, it is ensured that also the holding element is directly acted upon by the exhaust gas mass flow. While the material characteristics are the same or similar, this leads to a uniform expansion or shrinkage behavior of both components, so that a durable fastening is guarantied.

The characteristics indicated below allow additional developments and further developments of the turbine housing or of the vane apparatus for a VTG charger.

The recesses, which permit a direct action upon the holding elements by means of the exhaust gas flow, are advantageously placed in the generated surface of the spacing elements.

In this case, the recesses are constructed in a simple manner as bores, for example, four bores, which are each placed radially offset by 90 degrees with respect to one another in the generated surface.

As a second embodiment, the recesses are constructed as slots which are made from the direction of the face of the spacing elements.

Recesses, in which the spacing elements engage with their faces in a form-locking manner, are provided in the support and covering ring. This results in a fit by way of which transverse forces are absorbed, so that the holding elements are essentially free of transverse forces at this point.

Other objects, advantages, and novel features of the present invention will become apparent from the following detailed description of the invention when considered in conjunction with the accompanying drawings.

DETAILED DESCRIPTION

Figure 1:
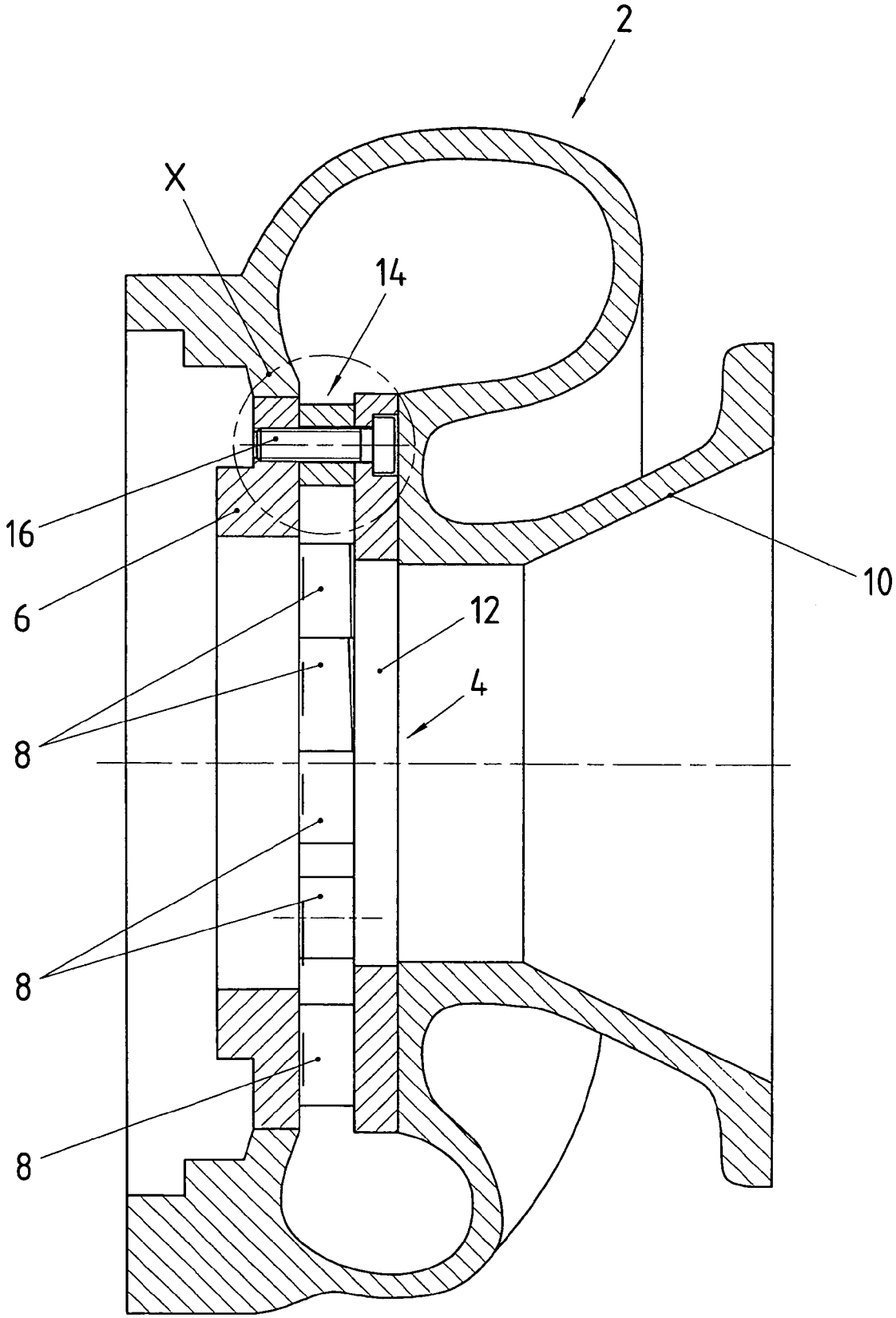
FIG. 1 is a cross-sectional view of a turbine housing of an exhaust gas turbocharger in accordance with an embodiment of the present invention.

A vane apparatus 4 is arranged in a turbine housing 2 of a so-called VTG exhaust gas turbocharger. The vane apparatus 4 consists of a support ring 6 to which vanes 8 are fastened which are adjustable for controlling the charge pressure. On their face assigned to the exhaust gas outlet 10, the vanes 8 are bounded by a covering ring 12. Spacing elements, which in the present case are constructed as spacing sleeves 14 and are radially distributed on the circumference of the support and covering ring 6, 12, the axial vane gap is defined. The spacing sleeves 14 are held by fastening elements which in the present embodiment are constructed as fastening screws 16. As an alternative, bolts, pins, or the like are also conceivable as the fastening elements for the spacing sleeves 14.

Figure 2:
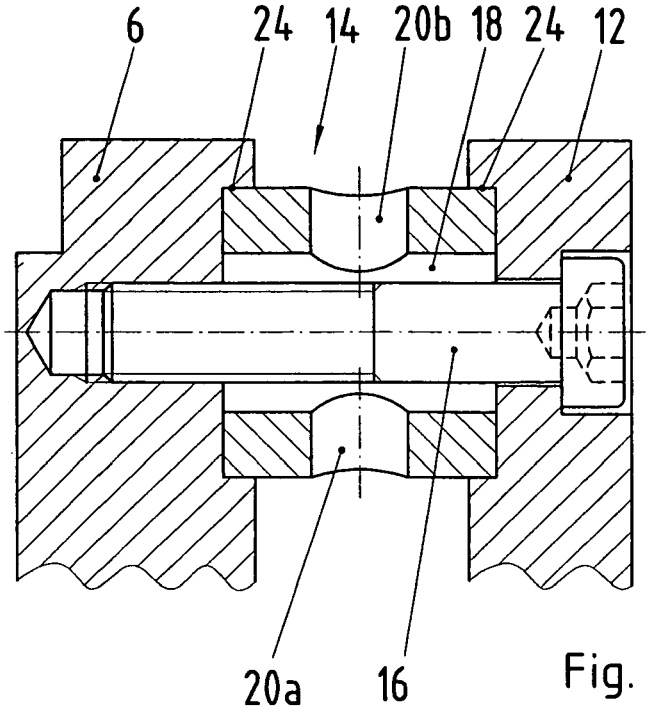
FIG. 2 is a view of an enlarged cutout X of FIG. 1 according to a first embodiment.

FIG. 2 shows a first embodiment of a spacing sleeve 14, in the case of which four recesses in the form of bores 20*a* to 20*d* are provided which are arranged to be radially offset with respect to one another by 90 degrees (in the sectional view according to FIG. 2, only two bores respectively are visible). The four bores 20*a* to 20*d* are connected with the passage opening 18 of the spacing sleeve 14 so that, in the operation of the exhaust gas turbocharger, the exhaust gas flow reaches the fastening screws 16 directly by way of the bores 20*a* to 20*d*. Naturally, other embodiments of recesses are also conceivable which, with respect to their shape and number, are correspondingly adapted to the concrete embodiment.

Figure 3:
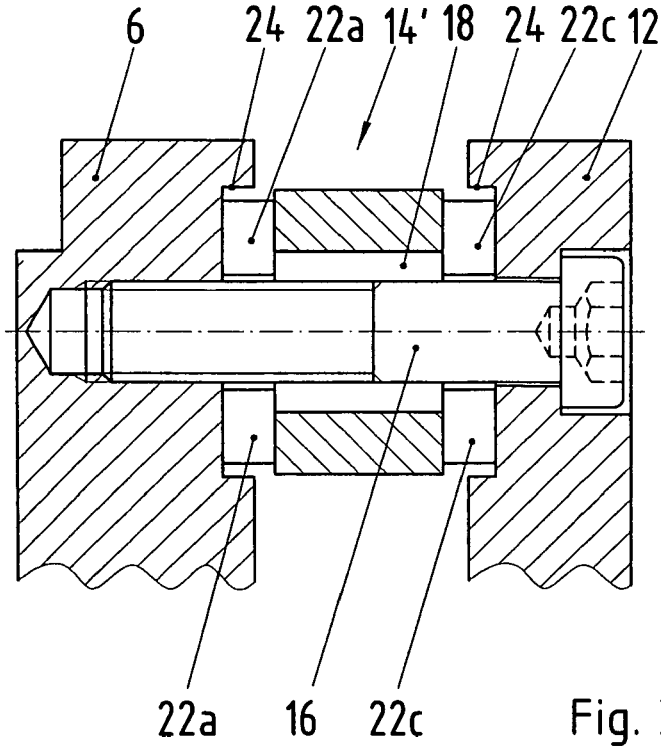
FIG. 3 is a view of an enlarged cutout X of FIG. 1 according to a second embodiment.
Figure 4:
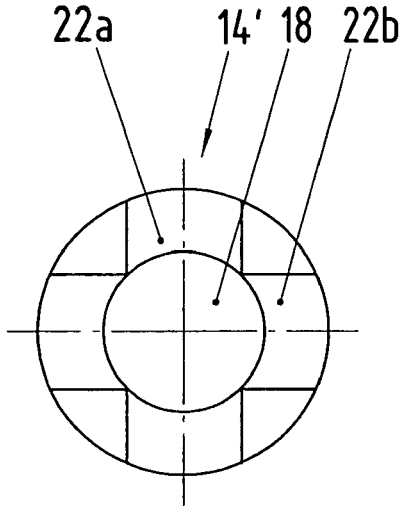
FIG. 4 is a frontal view of a spacing element according to the second embodiment.

FIG. 3 shows a second conceivable embodiment of a spacing sleeve 14', in the case of which the recesses are constructed as two slots 22*a* to 22*d* arranged with respect to one another in a cross shape. These slots 22*a* to 22*d* are each made at the left and right face of the spacing sleeve 14', for example, by a milling tool. As illustrated in FIG. 3, the circular-arc-shaped slots 22 have a depth which, analogous to the embodiment of FIG. 2, permit a direct action of the exhaust gas flow upon the fastening screws 16. Also in this embodiment, the diameter of the passage opening 18 of the spacing sleeve 14' is selected to be greater than the outside diameter of the fastening screws 16, so that the exhaust gas flow can flow by way of the slots 22*a* to 22*d* along the fastening screw 16.

In the first as well as the second illustrated embodiment, the spacing sleeves 14, 14' are accommodated on the face side in circular recesses 24 of the support ring 6 and covering ring 12. The recesses 24 are dimensioned such that the spacing sleeves 14 are held therein in a form-locking manner. As a result of the play-free fit, transverse forces can be absorbed so that the screwed connection itself remain free of transverse forces. The circular recesses 24 can, for example, be made by an electric discharge machining in the support ring 6 and covering ring 12. For this purpose, a tool is provided which, for example, has three pins by which the electric discharge machining can be carried out in one operation. As an alternative, the circular recesses 24 can also be produced by a casting process, for example, a MIM (metal injection molding) process or a precision casting process.

During the production or the mounting of the exhaust gas turbocharger, the spacing sleeves 14, 14' are aligned by corresponding positioning pins such that an optimal and uniform action of the exhaust gas mass flow is ensured.

The foregoing disclosure has been set forth merely to illustrate the invention and is not intended to be limiting. Since modifications of the invention may occur to persons skilled in the art, the invention should be construed to include everything within the scope of the appended claims and equivalents thereof.

What is claimed is:

1. A turbine housing of a variable turbine geometry exhaust gas turbocharger with an adjustable turbine geometry, comprising:

a support ring to which charge pressure-adjusting vanes are fastened;

a covering ring;

spacing elements; and fastening elements, wherein the support ring and the covering ring are spaced apart by the spacing elements, the spacing elements are each penetrated by one of the fastening elements, the fastening elements are fastened to at least one of the support ring and the covering ring, and the spacing elements have recesses which, during the operation of the exhaust gas turbocharger, permit a direct application of an exhaust gas flow upon the fastening elements.

2. The turbine housing according to claim 1, wherein the recesses are introduced through an outer surface of the spacing elements.

3. The turbine housing according to claim 2, wherein the recesses are constructed as bores.

4. The turbine housing according to claim 3, wherein the bores are arranged radially through the spacing elements relative to a longitudinal axis of the at least one fastening element therein.

5. The turbine housing according to claim 4, wherein recesses are provided in the support ring and the covering ring, and the recesses are formed such that face ends of each spacing element engage within opposing recesses when the spacing elements are fastened between the sporting ring and the covering ring.

6. The turbine housing according to claim 3, wherein recesses are provided in the support ring and the covering ring, and the recesses are formed such that face ends of each spacing element engage within opposing recesses when the spacing elements are fastened between the sporting ring and the covering ring.

7. The turbine housing according to claim 2, wherein the recesses are constructed in the spacing elements as slots arranged radially with respect to a longitudinal axis of the at least one fastening element therein.

8. The turbine housing according to claim 2, wherein recesses are provided in the support ring and the covering ring, and the recesses are formed such that face ends of each spacing element engage within opposing recesses when the spacing elements are fastened between the sporting ring and the covering ring.

9. The turbine housing according to claim 1, wherein recesses are provided in the support ring and the covering ring, and the recesses are formed such that face ends of each spacing element engage within opposing recesses when the spacing elements are fastened between the sporting ring and the covering ring.

10. The turbine housing according to claim 1, wherein a diameter of a passage opening of each spacing element which is penetrated by one of the fastening element is greater than an outside diameter of said fastening element.

* * * * *